US012031396B2

(12) United States Patent
Al-Huwaider et al.

(10) Patent No.: US 12,031,396 B2
(45) Date of Patent: Jul. 9, 2024

(54) METHOD AND APPARATUS OF GUIDED EXTEND REACH TRACTOR

(71) Applicant: SAUDI ARABIAN OIL COMPANY, Dhahran (SA)

(72) Inventors: Mustafa A. Al-Huwaider, Dhahran (SA); Shouxiang Ma, Dhahran (SA); Mamdouh N. Nasser, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/059,858

(22) Filed: Nov. 29, 2022

(65) Prior Publication Data

US 2024/0175328 A1 May 30, 2024

(51) Int. Cl.

| | |
|---|---|
| ***E21B 23/14*** | (2006.01) |
| ***E21B 23/00*** | (2006.01) |
| ***E21B 23/06*** | (2006.01) |

(52) U.S. Cl.

CPC ..... *E21B 23/001* (2020.05); *E21B 23/06* (2013.01); *E21B 23/14* (2013.01)

(58) Field of Classification Search

CPC ..... E21B 23/001; E21B 23/14

See application file for complete search history.

(56) References Cited

U.S. PATENT DOCUMENTS

| | | | |
|---|---|---|---|
| 4,676,310 | A | 6/1987 | Scherbatskoy et al. |
| 6,273,189 | B1 | 8/2001 | Gissler et al. |
| 6,715,559 | B2 | 4/2004 | Bloom et al. |
| 7,770,667 | B2 | 8/2010 | Moore |
| 7,954,563 | B2 | 6/2011 | Mock et al. |
| 8,028,766 | B2 | 10/2011 | Moore |
| 8,061,447 | B2 | 11/2011 | Krueger |
| 8,302,679 | B2 | 11/2012 | Mock |

(Continued)

FOREIGN PATENT DOCUMENTS

| | | |
|---|---|---|
| CA | 2551981 C | 9/2011 |
| CN | 202788700 U | 3/2013 |

(Continued)

OTHER PUBLICATIONS

L. S. Duthie et al.; "First Worldwide Slim coiled Tubing Logging Tractor Deployment", SPE-204432-MS; Society of Petroleum Engineers; Mar. 15, 2021; pp. 1-15 (15 pages).

(Continued)

*Primary Examiner* — Kenneth L Thompson

(74) *Attorney, Agent, or Firm* — Osha Bergman Watanabe & Burton LLP

(57) ABSTRACT

Systems and methods for a guided extend reach tractor are disclosed. The method includes installing a packer and a tractor string operatively connected to the packer in a borehole; lowering the guided extend reach tractor into the borehole; supplying power, via a power source, to the guided extend reach tractor; attaching the guided extend reach tractor to the tractor string using an electromagnet; and clamping the guided extend reach tractor onto the tractor string. The method further includes activating helical bars to propel the guided extend reach tractor forward or backward in the borehole; performing well intervention operations in the borehole; and extracting the guided extend reach tractor from the borehole.

6 Claims, 9 Drawing Sheets

(56) References Cited

U.S. PATENT DOCUMENTS

| | | | | |
|---|---|---|---|---|
| 8,555,963 | B2 | 10/2013 | Bloom et al. | |
| 8,770,303 | B2 | 7/2014 | Aguirre et al. | |
| 9,133,673 | B2 | 9/2015 | Hill et al. | |
| 9,447,648 | B2 | 9/2016 | Mitchell | |
| 9,488,020 | B2 | 11/2016 | Krueger | |
| 9,500,058 | B2 | 11/2016 | Tunc et al. | |
| 9,988,868 | B2 | 6/2018 | Bloom et al. | |
| 10,267,140 | B2 * | 4/2019 | Andreychuk | G01V 1/288 |
| 10,273,770 | B2 | 4/2019 | Van der Ende | |
| 10,589,433 | B2 * | 3/2020 | Al Nahwi | B08B 3/024 |
| 10,927,625 | B2 | 2/2021 | Fleckenstein et al. | |
| 11,054,536 | B2 * | 7/2021 | Jaaskelainen | E21B 47/135 |
| 11,098,546 | B2 * | 8/2021 | Varkey | E21B 17/1014 |
| 11,746,962 | B2 * | 9/2023 | Espinasse | F17D 5/00 73/865.8 |
| 2012/0313790 | A1 | 12/2012 | Heijnen et al. | |
| 2013/0180730 | A1 | 7/2013 | Bebak et al. | |

FOREIGN PATENT DOCUMENTS

| | | | |
|---|---|---|---|
| CN | 202788704 | U | 3/2013 |
| CN | 107083935 | A | 8/2017 |
| CN | 206830099 | U | 1/2018 |
| CN | 108204215 | A | 6/2018 |
| RU | 2517297 | C1 | 5/2014 |
| RU | 2707610 | C1 | 11/2019 |
| WO | 2017029606 | A1 | 2/2017 |
| WO | 2017029613 | A1 | 2/2017 |

OTHER PUBLICATIONS

A. Saeed et al.; "Case Study: Innovative World's Slimmest Coiled Tubing Tractor for Stimulation of Extended Reach Wells", SPE-192301-MS; Society of Petroleum Engineers; Apr. 2018; pp. 1-17 (17 pages).

M. S. Chowdhury et al.; "Production Logging and its Implementation: A Technical Review", International Journal of Petroleum and Petrochemical Engineering (IJPPE); vol. 5; Issue 2; 2019; pp. 42-51 (10 pages).

* cited by examiner

METHOD AND APPARATUS OF GUIDED EXTEND REACH TRACTOR

BACKGROUND

In the case of highly deviated horizontal wells, the weight of the drillstring is insufficient to allow for tools to reach the distal portion of a borehole and perform the operations of formation evaluation and well intervention such as stimulation, perforation, logging, etc. In such situations, traditional slickline and wireline have been replaced by coiled tubing, which can reach further downhole to access a targeted interval. Friction, however, may cause the coiled tubing to buckle while rigged in the borehole, thus limiting its access. A friction reducer may be used to extend the reach of the coiled tubing. While this can improve capability, it does not completely overcome the problem.

To improve the reach of well intervention tools in this situation, service providers have designed tractors that are attached to the coiled tubing and pull both the tools and coil tubing deeper into the well. These tractors use friction against the borehole wall to propel themselves downhole; they perform better in cased holes than in open holes due to borehole rugosity and variable hardness of the formation rock. Tractors may not work in certain openhole environments if the formations are loosely consolidated or unconsolidated. As a tractor goes deeper into the borehole, more pulling force is needed to overcome the increased friction from contact against the borehole wall. However, the casing or formation rock may fail under the high gripping force of the tractor. Therefore, a new mechanism is needed to overcome this challenge.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments disclosed herein relate to systems and methods for a guided extend reach tractor. The method includes installing a packer and a tractor string operatively connected to the packer in a borehole; lowering the guided extend reach tractor into the borehole; supplying power, via a power source, to the guided extend reach tractor; attaching the guided extend reach tractor to the tractor string using an electromagnet; and clamping the guided extend reach tractor onto the tractor string. The method further includes activating helical bars to propel the guided extend reach tractor forward or backward in the borehole; performing well intervention operations in the borehole; and extracting the guided extend reach tractor from the borehole.

In general, in one aspect, embodiments disclosed herein relate to a system including a tractor string operatively connected to a packer and placed in a borehole; a power source; and the packer configured to fix the tractor string in place in the borehole. The system further includes a guided extend reach tractor, including: an electromagnet, a solenoid operatively connected to the electromagnet and configured to be in a locked position or an unlocked position, the solenoid and electromagnet being configured to control the guided extend reach tractor to lock into the tractor string or release the tractor string, a pulling head configured to house the electromagnet and solenoid, the pulling head being operatively connected to a control head via a connecting rod, an orientation control motor configured to rotate the control head and the pulling head of the guided extend reach tractor, helical bars used by the guided extend reach tractor to traverse up and down the tractor string, and hydraulic arms configured to clamp the guided extend reach tractor onto the tractor string when the solenoid is in the locked position.

In general, in one aspect, embodiments disclosed herein relate to a guided extend reach tractor configured to traverse a borehole for performing a well intervention operation. The guided extend reach tractor includes a pulling head configured to house an electromagnet and a solenoid, the solenoid configured to be in a locked position or an unlocked position, the solenoid and electromagnet being configured to control the guided extend reach tractor to lock into a tractor string or release the tractor string, a control head operatively connected to the pulling head, an orientation control motor configured to rotate the control head and the pulling head of the guided extend reach tractor, helical bars forced by the electromagnet to be disposed against the tractor string, an electric motor with gears configured to rotate the helical bars of the guided extend reach tractor, and hydraulic arms configured to clamp the guided extend reach tractor onto the tractor string when the solenoid is in the locked position.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
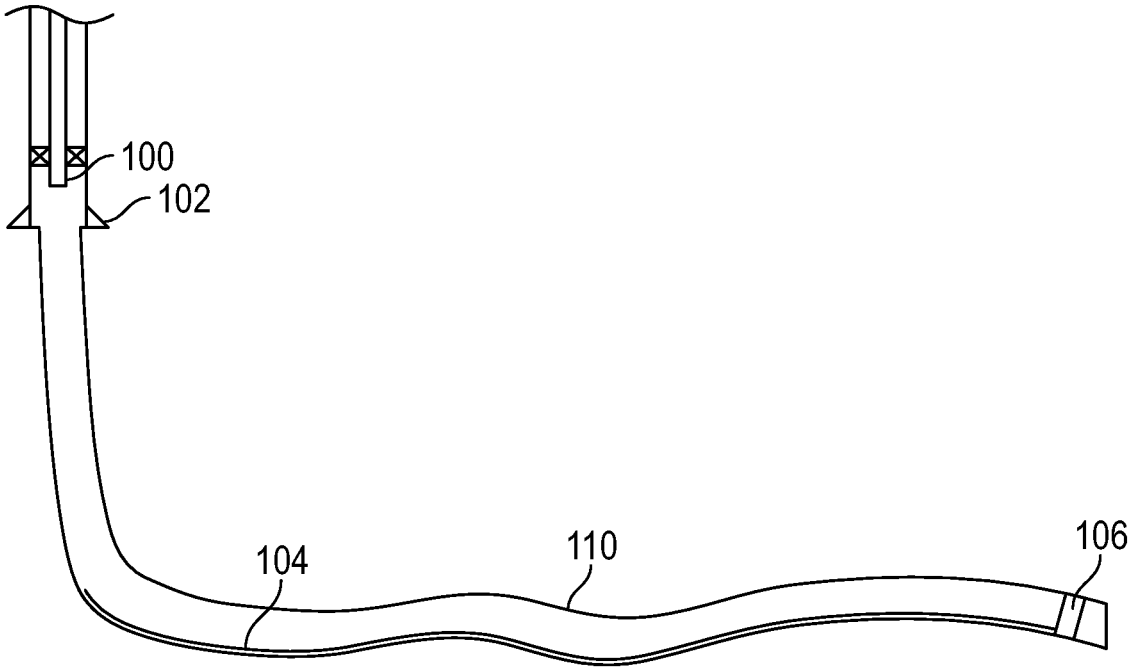
FIG. 1 shows a borehole with production tubing and a tractor string connected to a packer according to one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-7, any component described with regard to a figure, in various embodiments disclosed herein, may be equivalent to one or more like-named components described with regard to any other figure. For brevity, descriptions of these components may not be repeated for each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

In one aspect, embodiments disclosed herein relate to a method and apparatus of a guided extend reach tractor. These embodiments may provide at least one of the following advantages: A slim metallic string (or a flexible rail) is placed along a borehole and secured by a permanent or temporary, open or cased hole packer at the far end of the string; a new tractor design (the guided extend reach tractor) catches the string and locks onto it using a strong electromagnet and solenoid; helical spiral bars (worm gears), controlled by an electric motor, press against the string when rotated by the electric motor and provide backward or forward continuous motion, thus pulling coiled tubing or wireline string along with the tractor through the borehole.

The one or more embodiments disclosed herein advantageously provide a method and systems to extend the reach of a coiled tubing or wireline in highly deviated or horizontal wells to perform various well services. This method and related systems provide for continuous movement along with speed control; by gripping a string instead of the borehole formation or casing walls, the mechanism is simpler to deploy, cost-effective, and allows for the same well intervention operations to be performed as with traditional tractors.

Tool strings are lowered into boreholes in the energy industry for a variety of reasons, including to perform well logging, remediation, etc. The tool is inserted and retrieved from the borehole with a line. The tools usually require power while in the borehole to perform their functions. This power may come from a variety of sources (e.g., electrical, mechanical, battery, etc.).

Wireline is an electrically conductive cable usually comprising helically twisted wires surrounding an insulated conductive core. Electrical power may be passed along wireline from a surface facility to the tool. The wireline may also be used for communication between the surface facility and the tool in the borehole. Alternatively, a winch at the surface facility may generate mechanical power and transmit it down the borehole through steel cables known as slicklines. However, slicklines are normally not configured to deliver electrical power. Therefore, when using slickline, power for tools in the borehole is usually provided by batteries.

Coiled tubing, a continuous length of pipe wound on a spool, is widely used in place of slickline or wireline in the case of operating in a highly deviated or horizontal well. In such cases, the weight of the downhole instruments is insufficient to propel them to a targeted borehole interval for an intervention such as stimulation, perforation, logging, etc. The coiled tubing is forced through the borehole to access the targeted interval. However, friction between the coil tubing and borehole wall along with a buoyancy force can cause the coiled tubing to buckle and become stuck. To overcome this challenge, many service providers have created various types of tractors—machines that can be attached to the coiled tubing to pull it further into the well.

Conventional tractors come in one of several forms. It may be a conventional hydraulic tractor that uses pumped fluids through the coiled tubing to power a tractor turbine which, in turn, powers its hydraulic pump. Another conventional tractor design is the electro-hydraulic tractor. It contains a tractor portion that performs the same functions as the conventional hydraulic tractor. However, it also has subs (connectors) linking the tractor portion to other components, such as a generator, a turbine, a flow control apparatus, and a ball drop apparatus. For the electro-hydraulic tractor, the energy of fluid pumped down the borehole is converted to a mechanical energy, which is then converted to electrical energy to power the tractor's hydraulic pump. Yet another conventional tractor type is the mechanically and hydraulically operated tractor that moves through the borehole using a gripping and collapse mechanism powered by hydraulic and mechanical actuators.

Despite their effectiveness, conventional tractors have difficulty in highly deviated or horizontal wells where either the tractor does not have enough force to reach the distal end of the borehole, or else the tractor pulling mechanisms damage the borehole walls. To alleviate this problem, embodiments disclosed herein provide for a slim metallic tractor string that is placed along a borehole and fixed in place by a permanent or temporary open hole or cased hole packer. The packer is attached to the far end of the string. In one or more embodiments, a tractor is designed to catch and lock onto the string using a strong electromagnet and a solenoid. More specifically, the electromagnet forces the tool to attach its helical spiral bars (worm gears) against the string. In one or more embodiments, when the helical bars (worm gears) are rotated by the electric motor, a backward or forward continuous motion is generated due to the spiral helical shape of the bars. The friction from the strong electromagnet and helical motion pushes the tractor forward or backwards as needed to pull any string (coiled tubing or wireline) attached to the tractor deeper downhole.

FIG. 1 shows a borehole (110) containing production tubing (100) near the surface, followed by a casing shoe (102). Deeper down in the borehole (110), a tractor string (104) has been attached to the borehole wall. The tractor string (104) runs to the distal end of the borehole (110), where the tractor string (104) is secured by a permanent or temporary, open hole or cased hole packer (106). The tractor string (104) is a slim metallic string (10-20 mm in diameter), and acts as a rail upon which a tractor can move forward or backward. The packer (106) and the tractor string (104) can be run down the borehole (110) using a drill pipe. The packer (106) may be deployed as in a typical fashion (i.e., mechanically or hydraulically). Once the packer (106) is set, the drill pipe can be pulled out of the borehole (110) leaving behind the tractor string (104).

The tractor string (104) is made of a material such as stainless steel that is resistant to the corrosive compounds (e.g., $H_2S$ and $CO_2$) often encountered in the borehole (110) environment. In one or more embodiments, the tractor string is also coated with anti-corrosion and anti-scaling materials so that the tractor string (104) may last longer. Moreover, the tractor string (104) should have a weak point close to the packer (106) so that the tractor string (104) may be retrieved from the borehole (110) in a workover; this is useful if either a permanent packer (106) is used or if a temporary packer (106) is stuck. The weak point allows breaking of the string from the packer, so that the string is retrieved but the packer is left in place. The tractor string (104) surface should be rough to help the tractor grip it.

Figure 2:
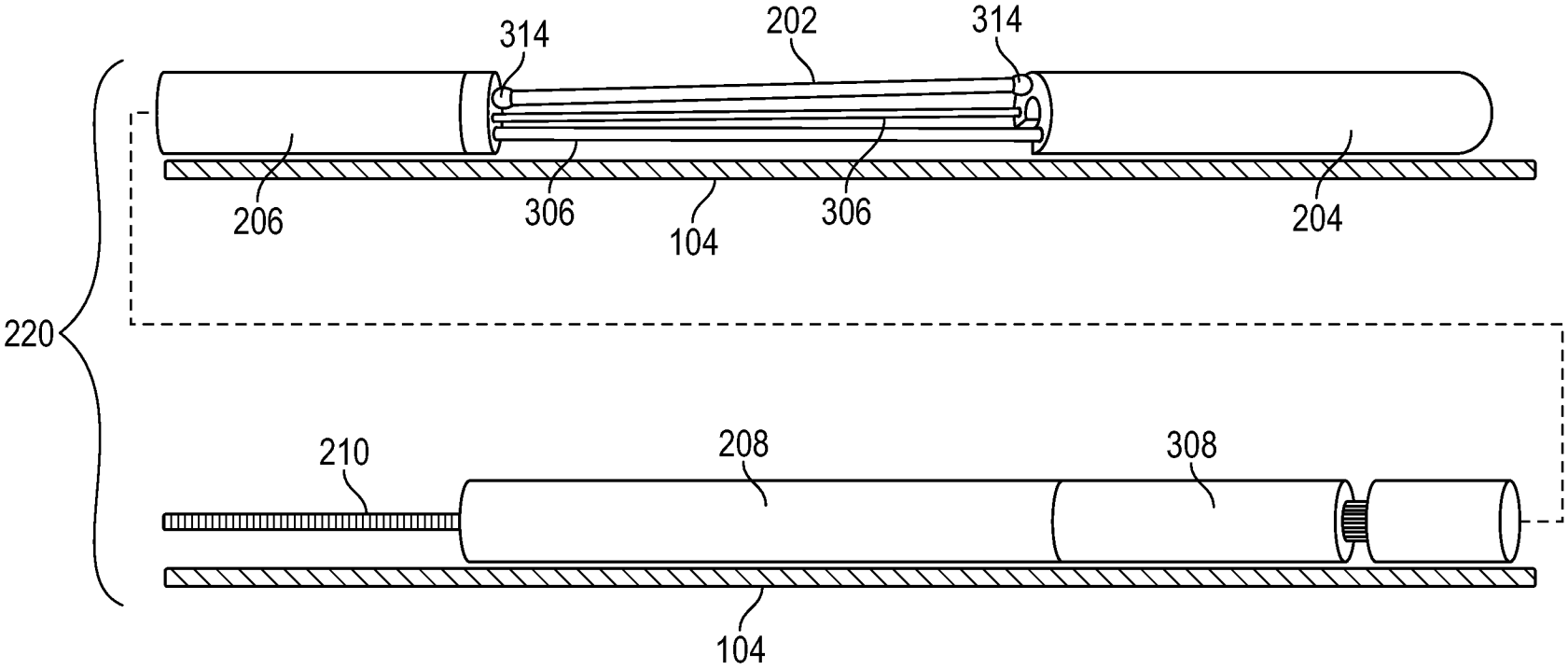
FIG. 2 shows an external view of the guided extend reach tractor according to one or more embodiments.
Figure 3:
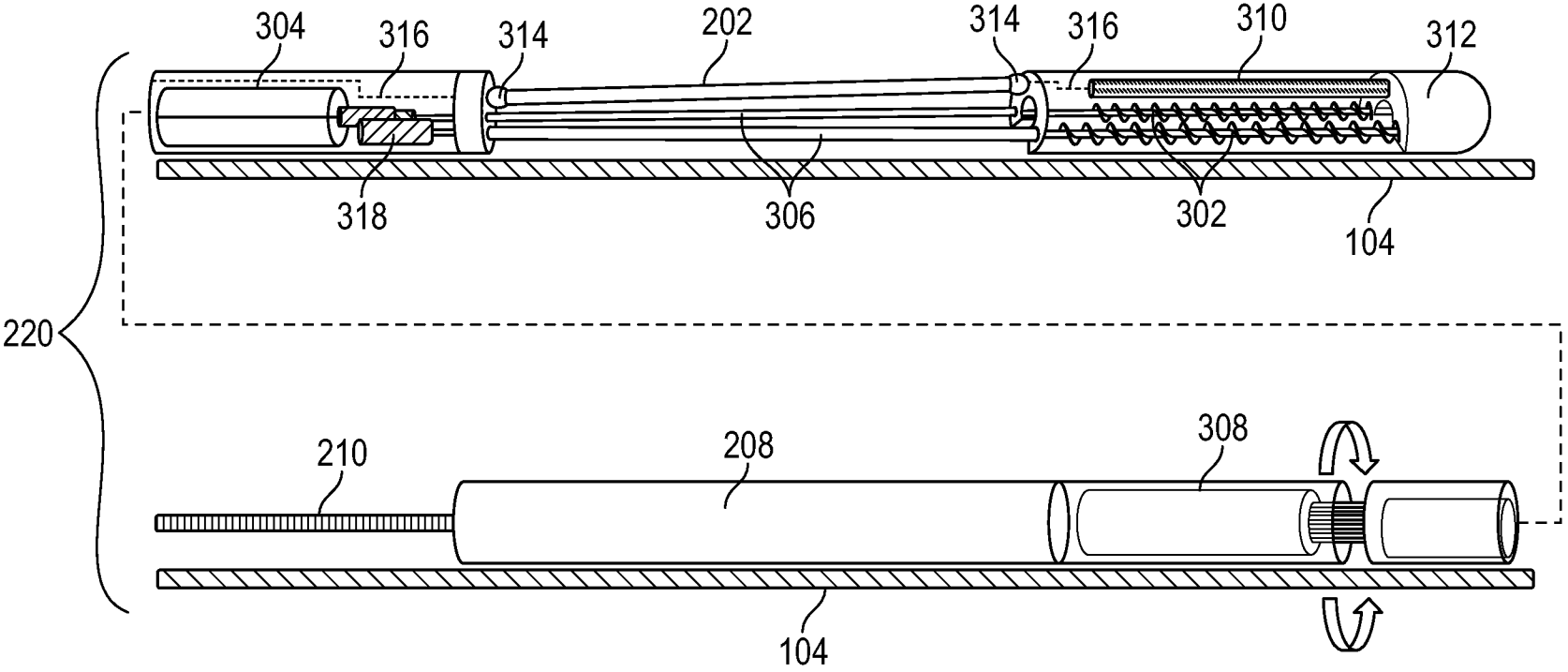
FIG. 3 shows an internal view of a guided extend reach tractor according to one or more embodiments.

In one or more embodiments, FIGS. 2, 3, and 4 show the guided extend reach tractor (220) designed to catch the tractor string (104) and lock onto it using a strong electromagnet (310) and a solenoid (312). Both the electromagnet (310) and the solenoid (312) are located in the pulling head (204). The pulling head (204) is also host to at least two helical bars (302) or worm gears. The pulling head (204) is connected to a control head (206) via connecting rod (202) with two spherical joints (314) to provide flexibility. The solenoid (312) and electromagnet (310) receive power through electrical wires (316) coming from the surface and passing through the connecting rod (202). In one or more embodiments, the helical bars (302) or worm gears are connected to and operated by an electric motor (304) with gears (318) inside the control head (206) that turn fixable shafts (306). In alternate embodiments, the fixable shafts (306) may be replaced by a rigid shaft with a universal joint. An orientation control motor (308) is placed behind the electric motor (304) that rotates both the control head (206) and pulling head (204) by up to 180 degrees clockwise or counterclockwise. The purpose of the tractor orientation control motor (308) is to help orient the pulling head (204), catch the tractor string (104), and force it inside the pulling head (204) opening.

The electromagnet (310) forces the guided extend reach tractor (220) to attach its helical bars (302) or worm gears against the tractor string (104). When the helical bars (302) or worm gears are rotated by the electric motor (304), a backward or forward continuous motion is generated due to the helical shape. The friction from the strong electromagnet (310) along with the helical motion pushes the guided extend reach tractor (220) forward or backward as needed to pull any attached tool (208) and the trailing wireline or coiled tubing (210) deeper down into the borehole (110). In one or more embodiments, when more gripping force is needed, a higher voltage can be supplied to the electromagnet (310).

Figure 4A:
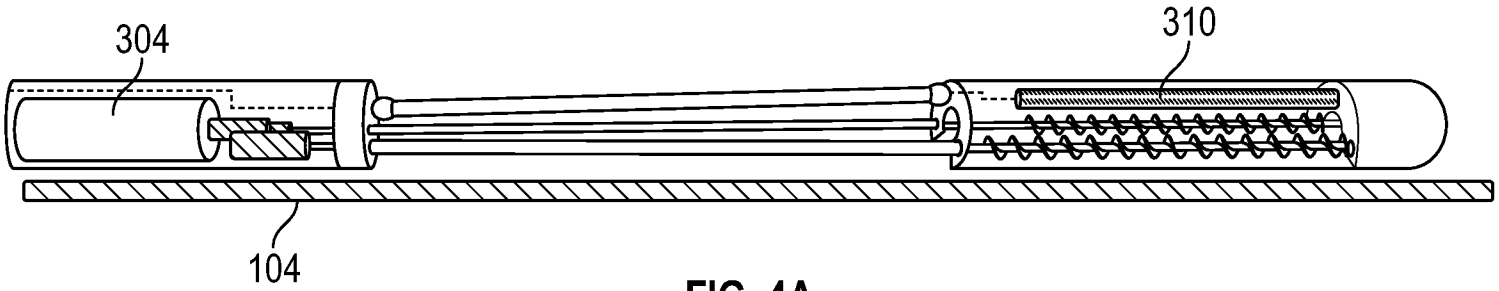
FIG. 4A shows the procedure for a guided extend reach tractor's engagement with a tractor string according to one or more embodiments.
Figure 4B:
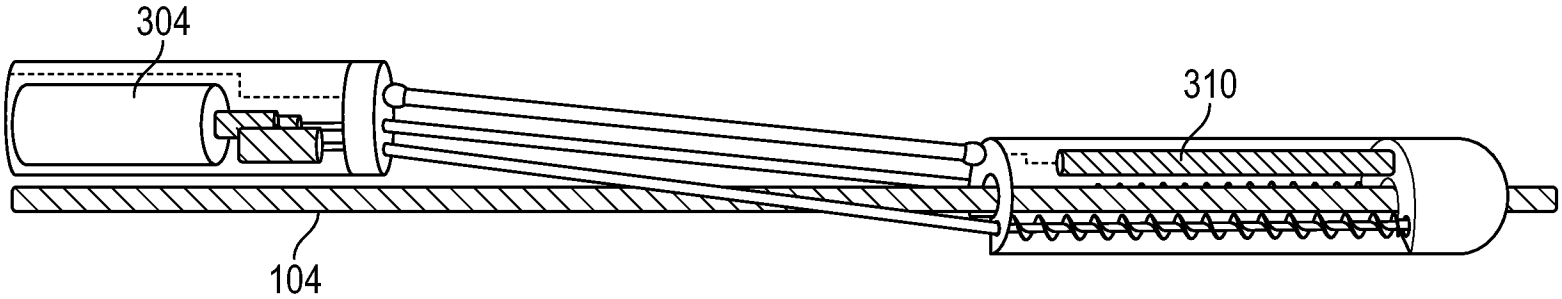
FIG. 4B shows the procedure for a guided extend reach tractor's engagement with a tractor string where the guided extend reach tractor has attached to the tractor string according to one or more embodiments.
Figure 4C:
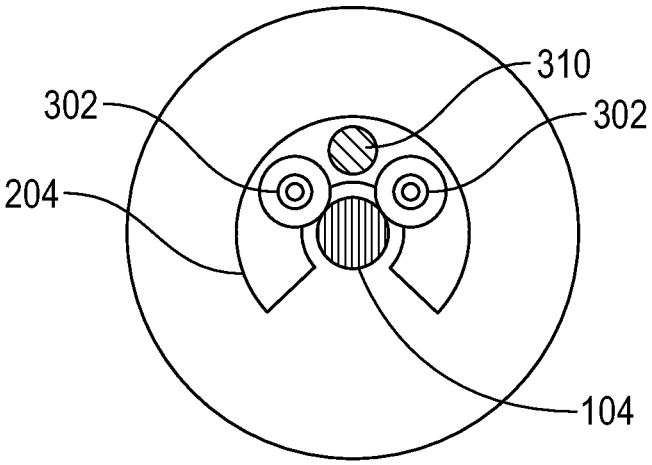
FIG. 4C shows a cross sectional view of guided extend reach tractor and a tractor string according to one or more embodiments.

FIGS. 4A and 4B show the sequence of operations for the guided extend reach tractor (220) to clamp onto a tractor string (104). FIG. 4C shows a cross-sectional view of the pulling head of the tractor string (104) (204). FIG. 4A depicts the guided extend reach tractor (220) before it clamps onto the tractor string (104). At the beginning of the operation, the electric motor (304) and the electromagnet (310) are off, and the solenoid (312) is unlocked. To clamp onto the tractor string (104) the electromagnet is first powered on. By turning on the electromagnet (310), the pulling head (204) latches onto the tractor string (104), as shown in FIG. 4B.

Figure 5A:
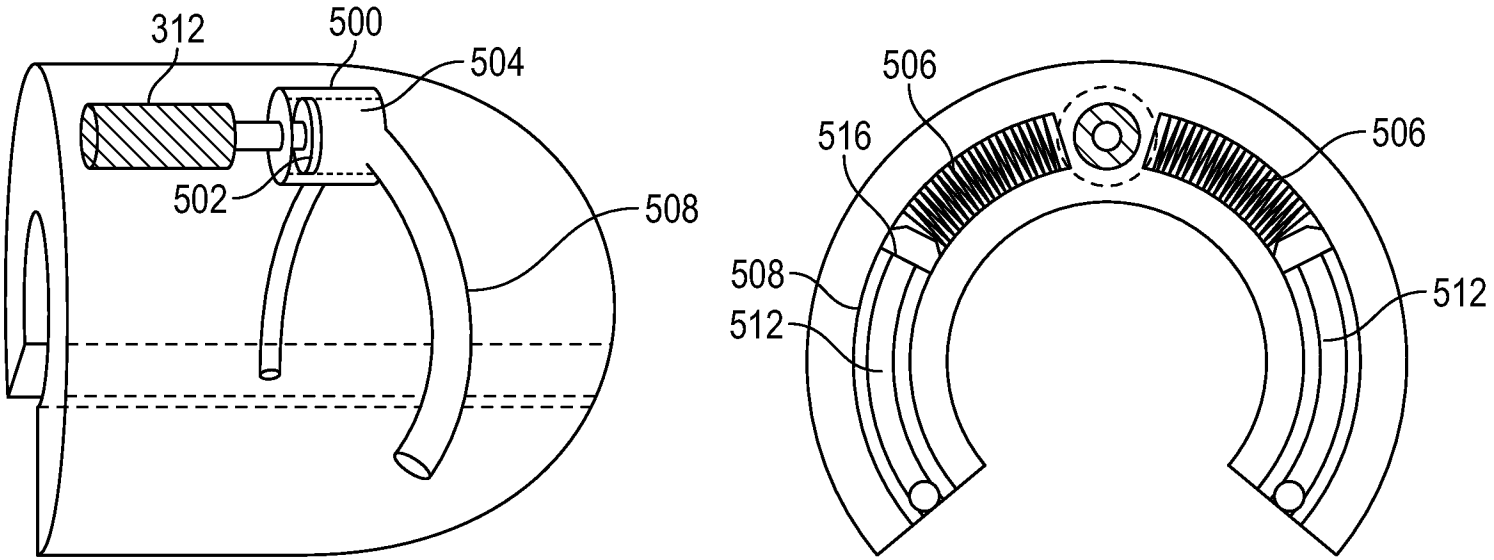
FIG. 5A shows the locking mechanism of the guided extend reach tractor in open position according to one or more embodiments.
Figure 5B:
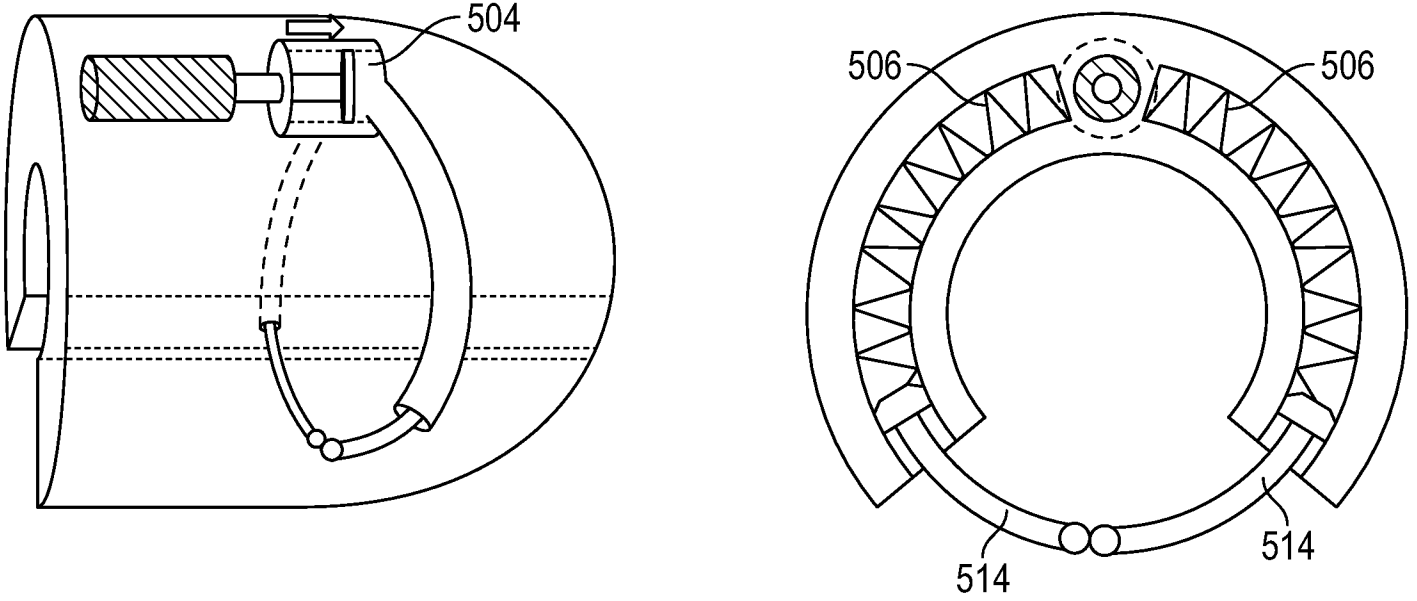
FIG. 5B shows the locking mechanism of the guided extend reach tractor in closed position according to one or more embodiments.

Before activating the helical bars (302), the solenoid (312) must be locked (shown in further detail in FIG. 5B). By locking the solenoid (312), the guided extend reach tractor (220) is firmly clamped to the tractor string (104). At this point, the electric motor is turned on and the guided extend reach tractor (220) may move along the tractor string (104). The cross-sectional view in FIG. 4C shows the layout of the electromagnet (310), helical bars (302) or worm gears, and tractor string (104), once the pulling head (204) has clamped onto the tractor string (104). This also allows the tractor head to unlock and release the tractor at any point in case of running issues.

FIG. 5A shows the locking/unlocking mechanism of the guided extend reach tractor's (220) pulling head (204) in the unlocked position. The solenoid (312) inside the head controls a piston (502) inside a hydraulic cylinder (500). The hydraulic cylinder (500) has two hydraulic arms (508) extending from its far end. Inside each arm is a spring (506) attached to a locking arm. When the springs (506) are compressed, the hydraulic arms (508) are in their initial position (512).

FIG. 5B shows the pulling head (204) when it is locked. When the springs (506) are uncompressed, the hydraulic arms (508) are in their extended position (514). To lock the head, the solenoid (312) pushes the piston (502) to press the hydraulic fluid (504) into the hydraulic arms (508). A hydraulic seal (516) contains the hydraulic fluid within the hydraulic arms (508). The hydraulic fluid, in turn, forces the hydraulic arms (508) to extend outside to lock onto the tractor string (104). To unlock, the solenoid (312) retrieves the piston (502) which makes the spring (506) pull the hydraulic arms (508) backward and release the tractor string (104).

Figure 6:
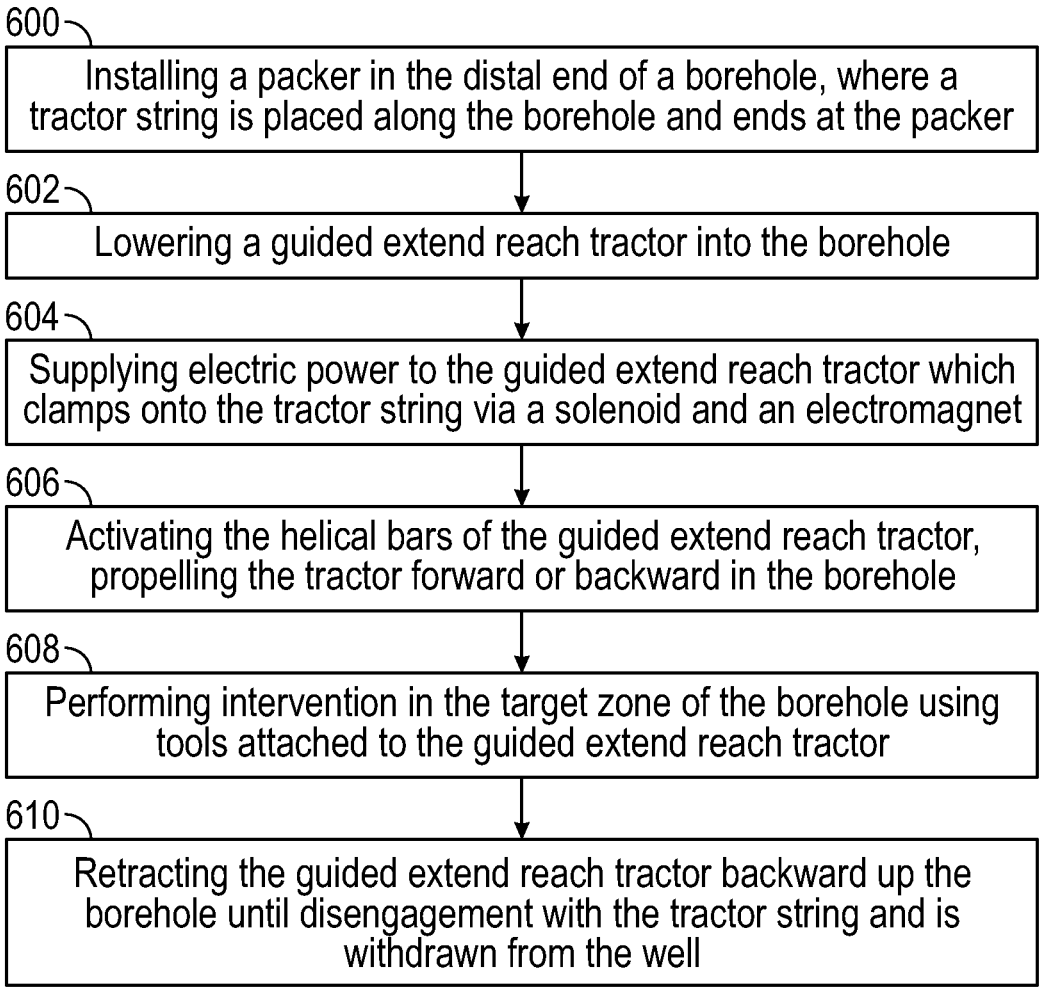
FIG. 6 shows a flowchart describing a method of using the guided extend reach tractor according to one or more embodiments.

FIG. 6 presents a workflow for the method of the guided extend reach tractor (220). To begin, a situation exists where it is impossible to deploy tools into a borehole (110) that is horizontal or highly deviated from vertical due to friction and the buoyancy force. In Step 600, a slim metallic tractor's string is placed along a borehole (110) and fixed in place by a permanent or temporary open hole or cased hole packer (106), installed at the far end of the borehole (110). The packer (106) with the string can be run using a drill pipe where the packer (106) is carried at the end of the drill pipe. The packer (106) can be deployed as a typical packer (106) (mechanically or hydraulically). Once the packer (106) is set, the drill pipe string can be pulled out of the hole leaving the tractor string (104) in the borehole (110). The tractor string (104) will act as a rail for the tractor to move forward and backward, and the packer (106) acts as an anchor attached to the far end of the tractor string (104).

In Step 602, the guided extend reach tractor (220) is lowered in the borehole (110) using coiled tubing (210) or wireline (100). In Step 604, electric power is supplied to the guided extend reach tractor (220), enabling its solenoid (312) and electromagnet (310) (both located in the pulling head (204)) to clamp onto to the tractor string (104). The guided extend reach tractor (220) is designed to catch the tractor string (104) and lock into it.

In Step 606, the helical bars (302) or worm gears of the tractor are activated, propelling the tractor in either direction in the borehole (110). The activation and force applied to the guided extend reach tractor (220) comes from the pulling head (204), which is connected to a control head (206) via a connecting rod (202), and is operated by an electric motor inside the control head (206).

In Step 608, as the tractor moves through the borehole (110), and a tool may be engaged, allowing for an intervention in the target zone of the borehole (110). The tool may perform, without limitation, well logging, stimulation, perforation, etc.

In Step 610, the guided extend reach tractor (220) is controlled to return up the borehole (110) toward the surface. The guided extend reach tractor (220) finally disengages from the tractor string (104), and is extracted from the borehole (110).

Figure 7:
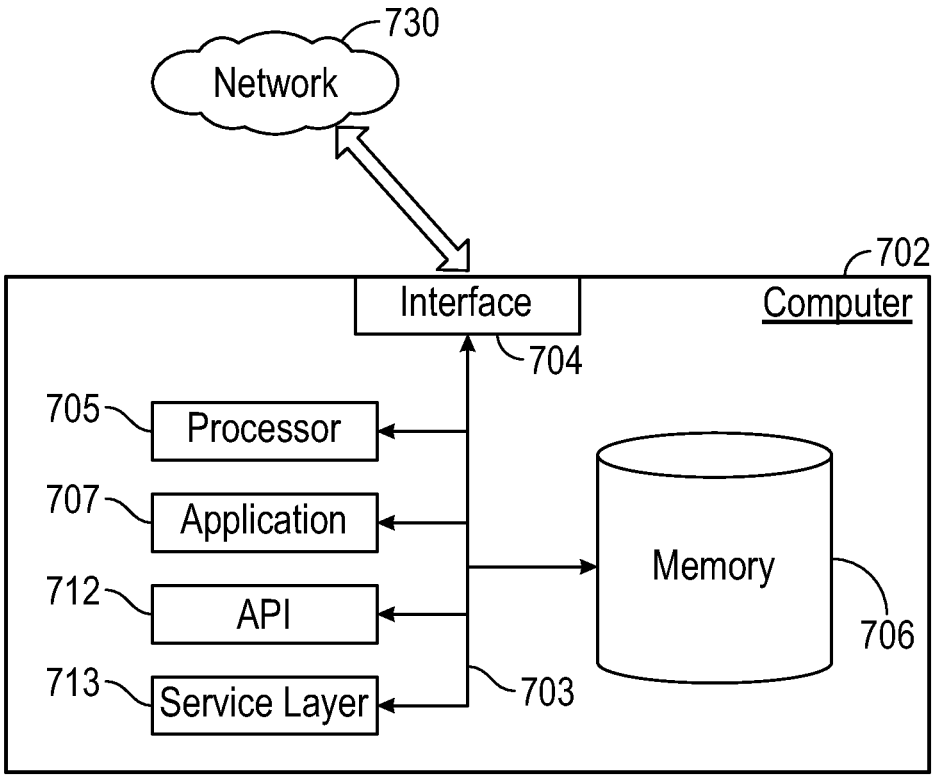
FIG. 7 shows a computer system according to one or more embodiments.

FIG. 7 depicts a block diagram of a computer system (702) used to provide computational functionalities associated with described algorithms, methods, functions, processes, flows, and procedures as described in this disclosure, according to one or more embodiments.

In particular, computational functionalities are required to first install a packer (106) in a borehole (110). The computer system (702) guides the drill pipe that carries the packer (106) to the distal end of the borehole (110). The computer system further (702) lowers the guided extend reach tractor (220) into the borehole (110), supplies power to the guided extend reach tractor (220), and clamps the guided extend reach tractor (220) onto a tractor string (104) while the guided extend reach tractor (220) is in the borehole (110). The computer system (702) rotates the control head (206) of the guided extend reach tractor (220) by up to 180 degrees in either direction, activates the helical bars (302) or worm gears of the guided extend reach tractor (220), propels the guided extend reach tractor (220) backwards and forwards along the tractor string (104), and performs any intervention in the borehole (110) (e.g., perforation, logging, etc.). All of these operations must be performed by an operator at the surface, thus necessitating the integrated computer system (702).

The illustrated computer (702) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (702) may include a computer that includes an input device, such as a keypad, keyboard, touch screen, or other device that can accept user information, and an output device that conveys information associated with the operation of the computer (702), including digital data, visual, or audio information (or a combination of information), or a GUI.

The computer (702) can serve in a role as a client, network component, a server, a database or other persistency, or any other component (or a combination of roles) of a computer system for performing the subject matter described in the instant disclosure. The illustrated computer (702) is communicably coupled with a network (730). In some implementations, one or more components of the computer (702) may be configured to operate within environments, including cloud-computing-based, local, global, or other environment (or a combination of environments).

At a high level, the computer (702) is an electronic computing device operable to receive, transmit, process, store, or manage data and information associated with the described subject matter. According to some implementations, the computer (702) may also include or be communicably coupled with an application server, e-mail server, web server, caching server, streaming data server, business intelligence (BI) server, or other server (or a combination of servers).

The computer (702) can receive requests over network (730) from a client application (for example, executing on another computer (702) and responding to the received requests by processing the said requests in an appropriate software application. In addition, requests may also be sent to the computer (702) from internal users (for example, from a command console or by other appropriate access method), external or third-parties, other automated applications, as well as any other appropriate entities, individuals, systems, or computers.

Each of the components of the computer (702) can communicate using a system bus (703). In some implementations, any or all of the components of the computer (702), both hardware or software (or a combination of hardware and software), may interface with each other or the interface (704) (or a combination of both) over the system bus (703) using an application programming interface (API) (712) or a service layer (713) (or a combination of the API (712) and service layer (713). The API (712) may include specifications for routines, data structures, and object classes. The API (712) may be either computer-language independent or dependent and refer to a complete interface, a single function, or even a set of APIs. The service layer (713) provides software services to the computer (702) or other components (whether or not illustrated) that are communicably coupled to the computer (702). The functionality of the computer (702) may be accessible for all service consumers using this service layer. Software services, such as those provided by the service layer (713), provide reusable, defined business functionalities through a defined interface. For example, the interface may be software written in JAVA, C++, or other suitable language providing data in extensible markup language (XML) format or another suitable format. While illustrated as an integrated component of the computer (702), alternative implementations may illustrate the API (712) or the service layer (713) as stand-alone components in relation to other components of the computer (702) or other components (whether or not illustrated) that are communicably coupled to the computer (702). Moreover, any or all parts of the API (712) or the service layer (713) may be implemented as child or sub-modules of another software module, enterprise application, or hardware module without departing from the scope of this disclosure.

The computer (702) includes an interface (704). Although illustrated as a single interface (704) in FIG. 7, two or more interfaces (704) may be used according to particular needs, desires, or particular implementations of the computer (702). The interface (704) is used by the computer (702) for communicating with other systems in a distributed environment that are connected to the network (730). Generally, the interface (704) includes logic encoded in software or hardware (or a combination of software and hardware) and operable to communicate with the network (730). More specifically, the interface (704) may include software supporting one or more communication protocols associated with communications such that the network (730) or interface's hardware is operable to communicate physical signals within and outside of the illustrated computer (702).

The computer (702) includes at least one computer processor (705). Although illustrated as a single computer processor (705) in FIG. 7, two or more processors may be used according to particular needs, desires, or particular implementations of the computer (702). Generally, the computer processor (705) executes instructions and manipulates data to perform the operations of the computer (702) and any algorithms, methods, functions, processes, flows, and procedures as described in the instant disclosure.

The computer (702) also includes a memory (706) that holds data for the computer (702) or other components (or a combination of both) that can be connected to the network (730). For example, memory (706) can be a database storing data consistent with this disclosure. Although illustrated as a single memory (706) in FIG. 7, two or more memories may be used according to particular needs, desires, or particular implementations of the computer (702) and the described functionality. While memory (706) is illustrated as an integral component of the computer (702), in alternative implementations, memory (706) can be external to the computer (702).

The application (707) is an algorithmic software engine providing functionality according to particular needs, desires, or particular implementations of the computer (702), particularly with respect to functionality described in this disclosure. For example, application (707) can serve as one or more components, modules, applications, etc. Further, although illustrated as a single application (707), the application (707) may be implemented as multiple applications (707) on the computer (702). In addition, although illustrated as integral to the computer (702), in alternative implementations, the application (707) can be external to the computer (702).

There may be any number of computers (702) associated with, or external to, a computer system containing computer (702), wherein each computer (702) communicates over network (730). Further, the term "client," "user," and other appropriate terminology may be used interchangeably as appropriate without departing from the scope of this disclosure. Moreover, this disclosure contemplates that many users may use one computer (702), or that one user may use multiple computers (702).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A guided extend reach tractor configured to traverse a borehole for performing a well intervention operation, comprising:

a pulling head configured to house an electromagnet and a solenoid, the solenoid configured to be in a locked position or an unlocked position, the solenoid and electromagnet being configured to control the guided extend reach tractor to lock into a tractor string or release the tractor string, a control head operatively connected to the pulling head, an orientation control motor configured to rotate the control head and the pulling head of the guided extend reach tractor, helical bars forced by the electromagnet to be disposed against the tractor string, an electric motor with gears configured to rotate the helical bars of the guided extend reach tractor, and hydraulic arms configured to clamp the guided extend reach tractor onto the tractor string when the solenoid is in the locked position.

2. The guided extend reach tractor of claim 1, wherein the hydraulic arms attach the control head to the tractor string and wherein helical bars propel the guided extend reach tractor forward and backward along the tractor string by way of a spiral shape of the helical bars.

3. The guided extend reach tractor of claim 1, wherein the solenoid is operatively connected to a piston that further pushes a hydraulic fluid into springs operatively connected to the hydraulic arms.

4. The guided extend reach tractor of claim 1, wherein the pulling head is operatively connected to the control head with a connecting rod through two spherical joints, and wherein the electric motor inside the control head comprises fixable shafts to operate the helical bars.

5. The guided extend reach tractor of claim 1, wherein the orientation control motor is configured to rotate both the control head and pulling head by up to 180 degrees clockwise or counterclockwise.

6. The guided extend reach tractor of claim 1, further comprising: an electric motor configured to control the helical bars to traverse along the tractor string.

* * * * *